US010952463B2

(12) United States Patent
Minzoni

(10) Patent No.: US 10,952,463 B2
(45) Date of Patent: Mar. 23, 2021

(54) AEROSOL-GENERATING ARTICLE AND LOW RESISTANCE SUPPORT ELEMENT FOR USE AS SEGMENT IN AN AEROSOL-GENERATING ARTICLE

(71) Applicant: PHILIP MORRIS PRODUCTS S.A., Neuchatel (CH)

(72) Inventor: Mirko Minzoni, Neuchatel (CH)

(73) Assignee: Philip Morris Products S.A., Neuchatel (CH)

( * ) Notice: Subject to any disclaimer, the term of this patent is extended or adjusted under 35 U.S.C. 154(b) by 358 days.

(21) Appl. No.: 15/755,608

(22) PCT Filed: Sep. 2, 2016

(86) PCT No.: PCT/EP2016/070674
§ 371 (c)(1),
(2) Date: Feb. 27, 2018

(87) PCT Pub. No.: WO2017/037209
PCT Pub. Date: Mar. 9, 2017

(65) Prior Publication Data

US 2019/0021392 A1 Jan. 24, 2019

(30) Foreign Application Priority Data

Sep. 3, 2015 (EP) ..... 15183664

(51) Int. Cl.
*A24D 3/04* (2006.01)
*A24D 3/18* (2006.01)

(52) U.S. Cl.
CPC ..... *A24D 3/048* (2013.01); *A24D 3/18* (2013.01)

(58) Field of Classification Search
CPC ..... A24D 3/048; A24D 3/18
(Continued)

(56) References Cited

U.S. PATENT DOCUMENTS 4,281,671 A * 8/1981 Bynre ..... A24D 3/0212 131/335
5,012,828 A * 5/1991 Hayes ..... A24D 3/0212 131/341
(Continued)

FOREIGN PATENT DOCUMENTS

CN 101420875 A 4/2009
CN 102159102 8/2011
(Continued)

OTHER PUBLICATIONS

Office Action issued in Russia for Application No. 2018111722/12 dated Nov. 13, 2019 (12 pages). English translation included.
(Continued)

*Primary Examiner* — Eric Yaary
*Assistant Examiner* — Russell E Sparks
(74) *Attorney, Agent, or Firm* — Mueting Raasch Group

(57) ABSTRACT

The aerosol-generating article (10) comprises a plurality of segments assembled in the form of a rod (11). The plurality of segments includes an aerosol-forming substrate (20) and a mouthpiece filter (50) located downstream from the aerosol-forming substrate (20) within the rod (11). The aerosol-generating article (10) further comprises activated carbon (45) disposed between the aerosol-forming substrate (20) and the mouthpiece filter (50) within the rod (11).

11 Claims, 1 Drawing Sheet

(58) Field of Classification Search
USPC ..... 131/335
See application file for complete search history.

(56) References Cited

U.S. PATENT DOCUMENTS

| | | | | |
|---|---|---|---|---|
| 6,615,843 | B2 * | 9/2003 | Pera | A24D 3/14 131/341 |
| 6,761,174 | B2 * | 7/2004 | Jupe | A24D 3/048 131/201 |
| 8,807,143 | B2 | 8/2014 | Fiebelkorn | |
| 9,185,939 | B2 | 11/2015 | Jarriault | |
| 9,961,936 | B2 * | 5/2018 | Grzonka | A24D 3/043 |
| 2002/0148478 | A1 | 10/2002 | Pera | |
| 2007/0186945 | A1 | 8/2007 | Olegario | |
| 2009/0314303 | A1 | 12/2009 | Awty | |
| 2011/0011414 | A1 * | 1/2011 | Hummel | B01J 20/08 131/332 |
| 2011/0247637 | A1 | 10/2011 | Duke | |
| 2011/0271968 | A1 | 11/2011 | Carpenter | |
| 2016/0205996 | A1 * | 7/2016 | John | A24D 1/002 |

FOREIGN PATENT DOCUMENTS

| | | |
|---|---|---|
| CN | 104270970 | 1/2015 |
| EP | 2324722 | 5/2011 |
| EP | 2462821 | 6/2012 |
| EP | 2888960 | 7/2015 |
| GB | 2223393 | 4/1990 |
| RU | 2421110 | 3/2010 |
| RU | 2520878 | 1/2013 |
| WO | WO 01/28371 | 4/2001 |
| WO | WO 02/069745 | 9/2002 |
| WO | WO 2005/032287 | 4/2005 |
| WO | WO 2017/117115 | 10/2007 |
| WO | WO 2010/032032 | 3/2010 |
| WO | WO 2011080007 | 7/2011 |
| WO | WO 2013034652 | 3/2013 |
| WO | WO 2013/120565 | 8/2013 |
| WO | WO 2013/120566 | 8/2013 |
| WO | WO 2014/140273 | 9/2014 |

OTHER PUBLICATIONS

PCT Search Report and Written Opinion for PCT/EP2016/070674 dated Feb. 2, 2017 (19 pages).
International Preliminary Report on Patentability for PCT/EP2016/0070674 dated Dec. 14, 2017 (16 pages).
Office Action issued in China for Application No. 201680050037.2 dated Apr. 2, 2020 (20 pages). English translation included.
Office Action issued in China for Application No. 201680050037.2 dated Dec. 2, 2020 (15 pages). English translation included.

* cited by examiner

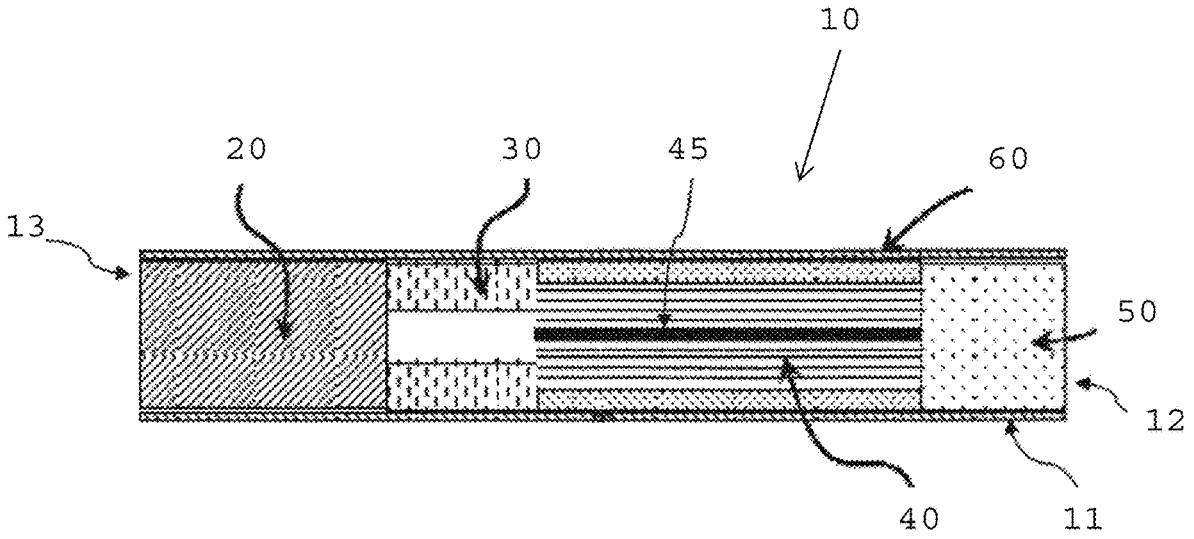
10
20
30
45
60
13
50
12
40
11

AEROSOL-GENERATING ARTICLE AND LOW RESISTANCE SUPPORT ELEMENT FOR USE AS SEGMENT IN AN AEROSOL-GENERATING ARTICLE

This application is a U.S. National Stage Application of International Application No. PCT/EP2016/070674, filed Sep. 2, 2016, which was published in English on Mar. 9, 2017, as International Publication No. WO 2017/037209 A1. International Application No. PCT/EP2016/070674 claims priority to European Application No. 15183664.0 filed Sep. 3, 2015.

The invention relates to an aerosol-generating article and a low resistance support element for use as segment of an aerosol-generating article. In particular, the invention relates to such articles and elements for imparting freshness to an aerosol.

Articles in which an aerosol-forming substrate, such as a tobacco containing substrate, is heated rather than combusted are known in the art. Typically in such heated aerosol-generating articles, an inhalable aerosol is generated by the transfer of heat from a heat source to an aerosol-forming substrate, which may be located within, around or downstream of the heat source. During consumption of the aerosol-generating article, volatile compounds are released from the aerosol-forming substrate by heat transfer from the heat source and entrained in air drawn through the article. As the released compounds cool, they condense to form an aerosol.

It is known to provide aerosol-generating articles as well as conventional cigarettes with single and multi-segment mouthpiece filters. These filter segments may comprise activated carbon and are provided to filter or reduce harmful or otherwise undesired compounds in the cigarette smoke. Activated carbon in a filter is at the same time known to have a certain freshness effect on the cigarette smoke.

It would now be desirable to provide freshness to an aerosol generated by heating an aerosol-forming substrate of an aerosol-generating article, however, without influencing a filtering effect of a mouthpiece filter of the article.

According to an aspect of the invention, there is provided an aerosol-generating article comprising a plurality of segments assembled in the form of a rod. The plurality of segments includes an aerosol-forming substrate and a mouthpiece filter located downstream from the aerosol-forming substrate within the rod. The aerosol-generating article further comprises activated carbon disposed between the aerosol-forming substrate and the mouthpiece filter within the rod.

While it is known to include specific flavourants, such as for example menthol, into other segments of an aerosol-generating article other than a filter segment or an aerosol-forming substrate, it has been surprising to find that it is possible to provide activated carbon between the aerosol-forming substrate and the mouthpiece filter, thereby altering the freshness of an aerosol but not or not noticeably influencing a filtering effect of the aerosol generated in the article. In particular, similar nicotine, glycerol and tobacco particulate matter (TPM) have been measured for an aerosol-generating article, with or without activated carbon provided in a polylactic acid aerosol-cooling element arranged between the aerosol-forming substrate and the mouthpiece filter.

It has been found that a small amount of activated carbon provided between the aerosol-forming substrate and the mouthpiece filter has a noticeable freshness effect for a user but does not or not significantly alter the nicotine content of the aerosol provided to a user.

Preferably, between 0.005 milligram and 0.1 milligram, more preferably between 0.008 milligram and 0.05 milligram, even more preferably between 0.01 milligram and 0.025 milligram, for example 0.02 milligram of activated carbon is disposed between the mouthpiece filter and the aerosol-forming substrate of each aerosol-generating article.

The activated carbon may be provided in particulate or compressed form. Preferably, activated carbon is provided in particulate form. Particles facilitate a distribution, preferably a homogeneous distribution, of the activated carbon in the article.

Particles of activated carbon may have sizes in a range between 0.1 micrometer and 10 micrometer, preferably, in a range between 0.5 micrometer and 4 micrometer, for example 1.5 micrometer.

Carbon particles of very small sizes and in small amounts have the further advantage to be easily disguised. For example, a segment of the aerosol-generating article comprising the activated carbon may not be rendered dark due to the presence of the carbon.

The distance between an aerosol-forming substrate and a mouthpiece filter in a typical aerosol-generating article is typically greater than the length of the mouthpiece filter. This intermediate section of an aerosol-generating article typically comprises a high proportion of free space within which an aerosol may form. By disposing the activated carbon between the aerosol-forming substrate and the mouthpiece filter, an aerosol formed may more freely pass the activated carbon than may be the case in the mouthpiece filter.

The activated carbon may be coupled to, or otherwise associated with, a carbon support element. The carbon support element may be any suitable substrate or support for locating, holding, or retaining the activated carbon.

The preferably between 0.005 milligram and 0.1 milligram of activated carbon may be coupled to the carbon support element. By this, the activated carbon is located on the carbon support element and may be located in the article and may not inadvertently relocate to other elements or segments of the aerosol-generating article. In addition, a carbon support element may facilitate a manufacturing of the aerosol-generating article. For example, a carbon support element may be pre-manufactured to contain activated carbon in a predefined form and dosage regime. The pre-manufactured carbon support element may then be introduced into the article or preferably into an element, which may be assembled with other elements or segments to from the aerosol-generating article.

A carbon support element may be an elongated element. Elongated carbon support elements allow to provide activated carbon along a certain and defined length of the aerosol-generating article. Thus, an amount of activated carbon in an article may be defined by the length of the carbon support element.

The carbon support element may be a fibrous support element. The fibrous support element may be, for example, a paper support.

The carbon support element may be an elongated support element in the form of a thread. A thread may be made, for example woven, braided or threaded, from fibers or filaments. The fibers or filaments may, for example, be cellulose based fibers or may be made of a polymeric material.

A thread may, for example, be woven, braided or threaded to activated carbon. Particles of activated carbon may also be incorporated into fibers or filaments. Preferably, incorporation is performed during forming of the filaments, for example, upon extrusion of filaments such as, for example, cellulose acetate filaments. The dry filaments containing the activated carbon may then be processed, for example, woven or braided, to form the thread.

A weight of the activated carbon to a weight of the carbon support element measured on a dry weight basis may be in a range between 0.05 percent and 0.5 percent, preferably in a range between 0.08 percent and 0.3 percent, for example 0.1 percent.

As a general rule, whenever a value is mentioned throughout this application, this is to be understood such that the value is explicitly disclosed. However, a value is also to be understood as not having to be exactly the particular value due to technical considerations. A value may, for example, include a range of values corresponding to the exact value plus or minus 20 percent.

Incorporation of activated carbon particles into fibers or filaments facilitates a location and homogenous distribution of the activated carbon in a carbon support element made of fibers and filaments. In addition, carbon particles may not be visible when incorporated onto a support element.

As used herein, an aerosol-generating article is any article that generates an inhalable aerosol when an aerosol-forming substrate is heated. The term includes articles that comprise an aerosol-forming substrate that is heated by a heat source, such as an electric heating element, for example a resistively or inductively heated heating element. An aerosol-generating article may be a non-combustible aerosol-generating article, which is an article that releases volatile compounds without the combustion of the aerosol-forming substrate. An aerosol-generating article may be a heated aerosol-generating article having an external or internal heat source, for example a combustible heat source, a resistively or an inductively heatable material in thermal or direct physical contact with the aerosol-forming substrate.

An aerosol-generating article may resemble a conventional smoking article, such as a cigarette and may comprise tobacco. An aerosol-generating article may be disposable. An aerosol-generating article may alternatively be partially-reusable and comprise a replenishable or replaceable aerosol-forming substrate.

As used herein, the term 'aerosol-forming substrate' relates to a substrate capable of releasing volatile compounds that can form an aerosol. Such volatile compounds may be released by heating the aerosol-forming substrate. An aerosol-forming substrate may be adsorbed, coated, impregnated or otherwise loaded onto a carrier or support. An aerosol-forming substrate may conveniently be part of an aerosol-generating article or smoking article.

An aerosol-forming substrate may comprise nicotine and other additive, for example flavorants. An aerosol-forming substrate may comprise tobacco, for example may comprise a tobacco-containing material containing volatile tobacco flavour compounds, which are released from the aerosol-forming substrate upon heating. An aerosol-forming substrate may comprise homogenised tobacco material, for example cast leaf tobacco. Alternatively, the aerosol-forming substrate may comprise a non-tobacco material.

Preferably, the aerosol-generating article is substantially cylindrical in shape. The aerosol-generating article may be substantially elongate. The aerosol-generating article may have a length and a circumference substantially perpendicular to the length. The aerosol-generating article may have a total length between 30 mm and 100 mm. The aerosol-generating article may have an external diameter between 5 mm and 12 mm.

The aerosol-forming substrate, as well as further element and segments of the aerosol-generating article may be substantially cylindrical in shape, may be substantially elongate and may also have a length and a circumference substantially perpendicular to the length.

The aerosol-forming substrate may be a solid aerosol-forming substrate. Alternatively, the aerosol-forming substrate may comprise both solid and liquid components.

The aerosol-forming substrate may further comprise an aerosol former. Examples of suitable aerosol formers are glycerine and propylene glycol.

If the aerosol-forming substrate is a solid aerosol-forming substrate, the solid aerosol-forming substrate may comprise, for example, one or more of: powder, granules, pellets, shreds, spaghettis, strips or sheets containing one or more of: herb leaf, tobacco leaf, fragments of tobacco ribs, reconstituted tobacco, homogenised tobacco, extruded tobacco and expanded tobacco. The solid aerosol-forming substrate may be in loose form, or may be provided in a suitable container or cartridge. For example, the aerosol-forming material of the solid aerosol-forming substrate may be contained within a paper or other wrapper and have the form of a plug.

Advantageously, the aerosol-generating article has a total length of 45 mm. The aerosol-generating article may have an external diameter of 7 mm. Further, the aerosol-forming substrate may have a length of 10 mm or 12 mm. A diameter of the aerosol-forming substrate may be between 5 mm and 12 mm.

The mouthpiece filter is located at the downstream end of the aerosol-generating article. The filter may be a cellulose acetate filter plug. Preferably, the mouthpiece filter is 7 mm in length, but may have a length of between 5 mm and 10 mm.

As used herein, the term 'rod' is used to denote a generally cylindrical element of substantially circular, oval or elliptical cross-section.

As used herein, the term 'longitudinal direction' refers to a direction extending along, or parallel to, the cylindrical axis of a rod.

The terms 'upstream' and 'downstream' may be used to describe relative positions of elements or segments of the aerosol-generating article. The terms 'upstream' and 'downstream' as used herein refer to a relative position along the rod of the aerosol-generating article with reference to the direction in which the aerosol is drawn through the rod.

Preferably, the plurality of elements or segments is assembled within a wrapper to form the rod. Suitable wrappers are known to those skilled in the art.

Where the intermediate section between the aerosol-forming substrate and the mouthpiece filter is enclosed within a wrapper, this section is effectively a cavity within which the activated carbon can be retained.

Preferably, the activated carbon is supported by an elongated carbon support element, for example a fibrous elongated carbon support element, such as a thread. Preferably, the elongated carbon support element is disposed radially inward from an inner surface of the wrapper within the rod. The elongated carbon support element has a longitudinal dimension, which is preferably disposed substantially parallel to a longitudinal axis of the rod.

The aerosol-generating article may comprise a low resistance support element located upstream of the mouthpiece filter and downstream of the aerosol-forming element. The low resistance support element comprises at least one longitudinally extending channel for locating the activated carbon in the low resistance support element and within the rod.

When consumed, a user draws air from the article by drawing on the mouthpiece filter. Aerosol generated within the article passes through the mouthpiece filter and may be inhaled by the user. It is desirable that the passage of air and aerosol between the aerosol-forming substrate and the mouthpiece filter should not meet with a great resistance. In other words, it is desirable that there is a minimal pressure drop between the aerosol-forming substrate and the mouthpiece filter. Thus, such a low resistance support element supporting the activated carbon or a carbon support element where activated carbon is coupled to, provides a low resistance to the passage of air along a longitudinal direction of the rod, thus a low resistance to draw (RTD). Resistance to draw (RTD) is the pressure required to force air through the full length of the object under test at the rate of 17.5 ml/sec at 22° C. and 101 kPa. RTD is typically expressed in units of $mmH_20$ and is measured in accordance with ISO 6565: 2011.

Preferably, the activated carbon is coupled to an elongated carbon support element and the elongated carbon support element is located by a channel in a low resistance support element. Thus, it is possible to form a low resistance support element containing the elongated carbon support element and then use the low resistance support element as a segment of the aerosol-generating article.

The low resistance support element may comprise a plurality of longitudinally extending channels. Preferably, the activated carbon is provided in at least one of the plurality of channels. At least one carbon support element coupled to the activated carbon may be arranged in at least one of the plurality of channels.

Preferably, a length of the carbon support element is equal to the length of the low resistance support element.

The plurality of longitudinally extending channels in the low resistance support element may be formed by processing a sheet material. The processing may include one or more processes selected from the list consisting of crimping, pleating, gathering or folding to form the plurality of longitudinally extending channels.

The plurality of longitudinally extending channels may be defined by a single sheet or by multiple sheets that has or have been crimped, pleated, gathered or folded to form multiple channels.

Preferably, an elongated carbon support element coupled to activated carbon is simultaneously deposited within one of the plurality of longitudinally extending channels during the forming of the sheet material.

As used herein, the term 'sheet' denotes a laminar element having a width and length substantially greater than the thickness thereof.

The low resistance support element may have a porosity of between 50 percent and 90 percent in the longitudinal direction.

The low resistance support element may have a total surface area of between 300 $mm^2$ per millimeter length and 1000 $mm^2$ per millimeter length forming an aerosol-cooling element. Preferably, the total surface area is about 500 $mm^2$ per millimeter. The low resistance support element in the form of an aerosol-cooling element may function as a heat exchanger to cool aerosol generated within the article.

The low resistance support element may be formed from a material having a thickness of between 5 micrometer and 500 micrometer, preferably, between 10 micrometer and 250 micrometer, for example 50 micrometer.

The low resistance support element may be formed from a material that has a specific surface area of between 10 $mm^2$ per milligram and 100 $mm^2$ per milligram, preferably, the specific surface area may be 35 $mm^2$ per milligram. Specific surface area can be determined by taking a material having a known width and thickness. For example, the material may be a polylactic acid (PLA) material having an average thickness of 50 micrometer with a variation of plus or minus 2 micrometer. Where the material also has a known width, for example, between 200 millimeter and 250 millimeter, the specific surface area and density can be calculated.

It is preferred that airflow through the low resistance support element does not deviate to a substantive extent between adjacent channels. In other words, it is preferred that the airflow through the low resistance support element is in a longitudinal direction along a longitudinal channel, without substantive radial deviation. Preferably, the low resistance support element is formed from a material that has a low porosity, or substantially no-porosity other than the longitudinally extending channels. That is, the material used to define or form the longitudinally extending channels, for example a crimped and gathered sheet, has low porosity or substantially no porosity.

The low resistance support element may be formed of or comprise a material selected from metal, polymer, paper or cardboard. The low resistance support element may be formed of or comprise a material selected from the group comprising polyethylene, polypropylene, polyvinylchloride, polyethylene terephthalate, polylactic acid, cellulose acetate, starch based copolyester, paper, and aluminium.

The low resistance support element may, for example be formed from a sheet material such as for example a metallic foil, a polymeric sheet, a substantially non-porous paper or cardboard, or a sheet material selected from the group consisting of polyethylene (PE), polypropylene (PP), polyvinylchloride (PVC), polyethylene terephthalate (PET), polylactic acid (PLA), cellulose acetate (CA), starch based copolyester, and aluminium foil.

A low resistance support element may be formed from a sheet of suitable material that has been pleated, gathered or folded into an element that defines a plurality of longitudinally extending channels. A cross-sectional profile of such an element may show the channels as being randomly oriented or as being at least partially regularly oriented. The low resistance support element may be formed by other means. For example, the low resistance support element may be formed from a bundle of longitudinally extending tubes. The low resistance support element may be formed by extrusion, molding, lamination, or injection of a suitable material.

The low resistance support element may comprise an outer tube or wrapper that contains or locates the longitudinally extending channels. For example, a pleated, gathered, or folded sheet material may be wrapped in a wrapper material, for example a plug wrapper, to form the low resistance support element. A low resistance support element comprising a sheet of crimped material that is gathered into a rod-shape may be bound by a wrapper, for example a wrapper of filter paper. Preferably, the activated carbon is incorporated within the low resistance support element as it is formed. For example, a thread coupled to activated carbon may be deposited within a channel of the low resistance support element as the channel is formed.

Preferably, the low resistance support element is formed in the shape of a rod having a length of between 7 millimeter and 28 millimeter. For example, a low resistance support element may have a length of 18 mm. In embodiments of an aerosol-generating article having a recessed filter, the low resistance support element may also be shorter, for example 13 millimeter. Preferably, the low resistance support element has a substantially circular cross-section and a diameter of 5 mm to 10 mm. For example, a low resistance support element may have a diameter of 7 mm.

The aerosol-generating article may comprise a spacer element located downstream of the aerosol-forming substrate. Preferably, the spacer element is located upstream of the activated carbon and the carbon support element, the activated carbon is coupled to. Preferably, the spacer element is arranged upstream of the low resistance support element comprising the activated carbon.

The spacer element may help to locate the aerosol-forming substrate. The spacer element may be substantially tubular and may provide free space within which an aerosol is able to condense. The spacer element may be a hollow tube, for example a hollow acetate tube.

According to another aspect of the invention, there is provided a low resistance support element. The low resistance support element comprises at least one longitudinally extending channel. Activated carbon is located within the at least one longitudinally extending channel of the low resistance support element. The low resistance support element may be made of a sheet material, which is, for example, crimped, gathered or folded such as to provide a plurality of elongated longitudinal channels. Activated carbon is then provided in at least one of the plurality of the elongated channels.

The low resistance support element may be used as a segment of an aerosol-generating article.

The low resistance support element may be any low resistance support element as described above in relation to the aerosol-generating article.

The low resistance support element may, for example, comprise an elongated carbon support element coupled to the activated carbon. The elongated carbon support element may be located within the at least one longitudinally extending channel.

Preferably, the elongated carbon support element is formed by filaments. Activated carbon in the form of particles may be incorporated in the filaments forming the elongated carbon support element.

In a specific example of a low resistance support element, the element is an aerosol-cooling element made of a crimped PLA sheet and has a length of 18 mm. The aerosol-cooling element comprises a carbon support element in the form of a thread of 18 mm length arranged along the length of the aerosol-cooling element. With an inclusion of 0.1 percent w(carbon)/w(thread material) about 0.02 mg activated carbon is provided in the thread of the low resistance support element or of the aerosol-generating article comprising the thread. With a cellulose acetate thread material (for example Cellulose-2.5-acetate), a total weight of the thread results to about 20 mg per aerosol-generating article. An aerosol-cooling element for application in articles having recessed filters may be shorter than 18 mm. A standard length of an aerosol-cooling element for use together with recessed filters is 13 mm. Accordingly, the length of the thread may also be shorter and preferably corresponds to the length of the aerosol-cooling element. Thus, if a same thread is used, the amount of activated carbon for a 13 mm thread is about 0.015 mg. However, for shorter aerosol-cooling elements also threads comprising larger amounts of activated carbon per length may be used, such that the shorter aerosol-cooling element may also comprise, for example 0.02 mg or more activated carbon.

The invention is further described with regard to an embodiment, which is illustrated by means of the FIGURE.

The FIGURE is a schematic cross-sectional diagram of an aerosol-generating article 10. The article 10 comprises four elements, an aerosol-forming substrate 20, a hollow cellulose acetate tube 30, a low resistance support element 40 comprising an activated carbon containing thread 45, and a mouthpiece filter 50. These four elements are arranged sequentially and in coaxial alignment and are assembled by a wrapping material 60, for example a cigarette paper, to form a rod 11. The rod 11 has a mouth end 12, which a user may insert into his or her mouth during use, and a distal end 13 located at the opposite end of the rod 11 and to the mouth end 12. Elements located between the mouth end 12 and the distal end 13 can be described as being upstream of the mouth end 12 or, alternatively, downstream of the distal end 13. The article illustrated in the FIGURE is suitable for use with an aerosol-generating device comprising a heater for heating the aerosol-forming substrate.

When assembled, the rod 11 is about 45 mm in length and has an outer diameter of about 7.2 mm.

The aerosol-forming substrate 20 is located upstream of the hollow tube 30 and extends to the distal end 13 of the rod 11. The aerosol-forming substrate 20 preferably comprises a bundle of crimped cast-leaf tobacco wrapped in a wrapping paper (not shown) to form a plug. The cast-leaf tobacco includes additives, including, for example, glycerine as an aerosol-forming additive. The aerosol-forming substrate may also comprise susceptor material, depending on the way of heating the substrate 20 as will be described in more detail below.

The hollow tube 30 is located immediately downstream of the aerosol-forming substrate 20 and is formed from cellulose acetate. One function of the hollow tube 30 is to locate the aerosol-forming substrate 20 towards the distal end 13 of the rod 11 so that it can be contacted with a heating element. The hollow tube 30 acts to prevent the aerosol-forming substrate 20 from being forced along the rod 11 towards the low resistance support element 40, for example, when a heating element is inserted into the aerosol-forming substrate 20. The hollow tube 30 also acts as a spacer element to space the low resistance support element 40 from the aerosol-forming substrate 20.

The low resistance support element 40 has a length of about 18 mm with a mouthpiece filter 50 as shown in the FIGURE. In an aerosol-generating article comprising a recessed filter, typically the mouthpiece filter is supplemented with a tubular element, for example a cardboard tube, forming the recess at the mouthpiece end 12 of the article 10. In such embodiments, the length of the low resistance element is about 13 mm.

The low resistance support element has an outer diameter of about 7.1 mm. The low resistance support element 40 is formed from a sheet of polylactic acid having a thickness of 50 mm plus or minus 2 mm. The sheet of polylactic acid has been crimped and gathered to define a plurality of channels that extend along the length of the low resistance support element 40. Such a low resistance support element forms an aerosol-cooling element. To form the element, a sheet of polylactic acid is fed through crimping rollers to produce longitudinal crimps or corrugations. The crimped sheet is then gathered to form a cylinder having a plurality of longitudinally extending channels. During the formation of the support element 40, an active carbon containing thread 45 is deposited into the crimped sheet parallel to the longitudinal crimps. Thus, the activated carbon containing thread 45 is incorporated within a longitudinal channel of the low resistance support element 40 as it is formed. The activated carbon containing thread 45 has a same length as the low resistance support element 40 and extends along the longitudinal axis of the low resistance support element 40 and of the article 10. The activated carbon containing thread 45 is loaded with a sufficient amount of activated carbon so as to provide an activated carbon load to element 40 of approximately 0.02 mg carbon.

The carbon containing thread 45 may be a cotton thread or an acetate thread. Preferably, the thread 45 is made of cellulose acetate filaments, wherein activated carbon particles have been incorporated during manufacture of the filaments, for example during extrusion. The filaments may be threaded or woven to form the thread 45. The total surface area of the low resistance support element 40 is between 8000 $mm^2$ and 9000 $mm^2$, which is equivalent to approximately 500 $mm^2$ per mm length. The specific surface area of the low resistance support element 40 is approximately 2.5 $mm^2$ per mg and it has a porosity of between 60 percent and 90 percent in the longitudinal direction.

Porosity is defined herein as a measure of unfilled space in a rod including an aerosol-cooling element consistent with the one discussed herein. For example, if a diameter of the rod 11 was 50 percent unfilled by the low resistance support element 40, the porosity would be 50 percent. Likewise, a rod would have a porosity of 100 percent if the inner diameter was completely unfilled and a porosity of 0 percent if completely filled. The porosity may be calculated using known methods. An exemplary illustration of how porosity may be calculated is for example described and shown in the international patent publication WO 2013/120566.

The higher the porosity in the longitudinal direction, the lower the resistance of the element 40.

The mouthpiece filter 50 is a conventional mouthpiece filter formed from cellulose acetate, and having a length of about 7 millimetres.

The four elements identified above are assembled by being tightly wrapped within the wrapping material 60. The wrapping material 60 may be a conventional cigarette paper having standard properties. The interference between the wrapping material 60 and each of the elements locates the elements and defines the rod 11 of the aerosol-generating article 10.

Although the specific embodiment illustrated in the FIGURE has four elements assembled in a cigarette paper, it is clear than an aerosol-generating article may have additional elements or fewer elements.

An aerosol-generating article 10 as illustrated in the FIGURE is designed to engage with an aerosol-generating device (not shown) in order to be consumed. Such an aerosol-generating device includes means for heating the aerosol-forming substrate 20 to a sufficient temperature to form an aerosol. Typically, the aerosol-generating device may comprise a heating element that surrounds the aerosol-generating article adjacent to the aerosol-forming substrate 20, a heating element that is inserted into the aerosol-forming substrate 20 or an inductor that may inductively heat an inductively heatable material provided within the aerosol-forming substrate or in thermal contact with the aerosol-forming substrate. Once engaged with an aerosol-generating device, the aerosol-forming substrate 20 is heated to a temperature of above 250 degrees Celsius and a user may draw on the mouth end 12 of the aerosol-generating article 10. At this temperature, volatile compounds are evolved from the aerosol-forming substrate 20. These compounds condense to form an aerosol. The aerosol is drawn through the rod 11 towards the mouth end 12.

As the aerosol is drawn through the rod 11, the activated carbon containing thread 45 and the mouthpiece filter 50 is also entrained in the aerosol to provide a specific freshness experience for a user.

In a variant of the embodiment shown in the FIGURE the article is not designed to engage with an aerosol-generating device but comprises a combustible heat source that may be ignited and transfer heat to the aerosol-forming substrate 20 to form an inhalable aerosol. The combustible heat source may be a charcoal element that is assembled in proximity to the aerosol-forming substrate at the distal end 13 of the rod 11. The other elements of the aerosol-generating article may be the same.

The invention claimed is:

1. An aerosol-generating article comprising a plurality of segments assembled in the form of a rod, the plurality of segments including an aerosol-forming substrate and a mouthpiece filter located downstream from the aerosol-forming substrate within the rod, the aerosol-generating article further comprising between 0.008 milligram and 0.05 milligram of activated carbon disposed between the aerosol-forming substrate and the mouthpiece filter within the rod, wherein the activated carbon is coupled to an elongated carbon support element in the form of a thread.

2. The aerosol-generating article according to claim 1, wherein the activated carbon is provided in particle form, the particles having sizes in a range between 0.1 micrometer and 10 micrometer.

3. The aerosol-generating article according to claim 1, wherein the thread is made of fibers or filaments, and wherein particles of activated carbon are incorporated into the fibers or filaments.

4. The aerosol-generating article according to claim 1, wherein a weight of the activated carbon to a weight of the carbon support element on a dry weight basis is in a range between 0.05 percent and 0.5 percent.

5. The aerosol-generating article according to claim 1, wherein the plurality of segments are assembled within a wrapper to form the rod, the elongated carbon support element being disposed radially inward from an inner surface of the wrapper within the rod and having a longitudinal dimension disposed substantially parallel to a longitudinal axis of the rod.

6. The aerosol-generating article according to claim 1, comprising a low resistance support element located upstream of the mouthpiece and downstream of the aerosol-forming substrate, the low resistance support element having a porosity between 50 percent and 90 percent in the longitudinal direction and providing a low resistance to draw (RTD), and comprising a longitudinally extending channel for locating the activated carbon within the longitudinally extending channel.

7. The aerosol-generating article according to claim 6, wherein the low resistance support element is formed of or comprises a material selected from the group comprising polyethylene, polypropylene, polyvinylchloride, polyethylene terephthalate, polylactic acid, cellulose acetate, starch based copolyester, paper, and aluminium.

8. The aerosol-generating article according to claim 6, wherein the low resistance support element is an aerosol-cooling element having a total surface area of between 300 $mm^2$ per mm length and 1000 $mm^2$ per mm length.

9. The aerosol-generating article according to claim 7, wherein the low resistance support element is an aerosol-cooling element having a total surface area of between 300 $mm^2$ per mm length and 1000 $mm^2$ per mm length.

10. A low resistance support element for use as segment of an aerosol-generating article, the low resistance support element having a porosity between 50 percent and 90 percent in the longitudinal direction and comprising at least one longitudinally extending channel, wherein between 0.008 milligram and 0.05 milligram of activated carbon is coupled to an elongated carbon support element in the form of a thread, which elongated carbon support element is located within the at least one longitudinally extending channel.

11. A low resistance support element according to claim 10, wherein the elongated carbon support element is formed by filaments, wherein the activated carbon is in the form of particles, and wherein the particles of activated carbon are incorporated in the filaments forming the elongated carbon support element.

* * * * *